US006327936B1

(12) United States Patent
Eguren

(10) Patent No.: US 6,327,936 B1
(45) Date of Patent: Dec. 11, 2001

(54) PORTABLE CORK-SCREW

(76) Inventor: Jacinto Presa Eguren, Avenida de Atenas 75, E-29230 Las Rozas (ES)

( * ) Notice: Subject to any disclaimer, the term of this patent is extended or adjusted under 35 U.S.C. 154(b) by 0 days.

(21) Appl. No.: 09/623,234

(22) PCT Filed: Dec. 29, 1999

(86) PCT No.: PCT/ES99/00409

§ 371 Date: Nov. 14, 2000

§ 102(e) Date: Nov. 14, 2000

(87) PCT Pub. No.: WO00/40499

PCT Pub. Date: Jul. 13, 2000

(30) Foreign Application Priority Data

Dec. 31, 1998 (ES) ..... 9803278

(51) Int. Cl.[7] ..... B67B 7/04
(52) U.S. Cl. ..... 81/3.47; 81/3.09
(58) Field of Search ..... 81/3.09, 3.35, 81/3.37, 3.47, 3.48, 3.49, 3.57

(56) References Cited

U.S. PATENT DOCUMENTS 786,492 * 4/1905 Garimaldi ..... 81/3.09
4,437,359 * 3/1984 Dejoux et al. ..... 81/3.09
5,992,269 11/1999 Puig et al. .
6,101,900 * 8/2000 Traspuesto Miguel ..... 81/3.48

FOREIGN PATENT DOCUMENTS 102 06 37 7/1992 (ES) .
103 56 71 5/1997 (ES) .

* cited by examiner

*Primary Examiner*—Joseph J. Hail, III
*Assistant Examiner*—David B Thomas
(74) *Attorney, Agent, or Firm*—Michael J. Striker

(57) ABSTRACT

The invention relates to a portable cork-screw provided with a conventional spiral-shaped extraction means which is articulated to the body in a position offset towards one of its extremities, said body having a C-shaped cross-section, and having in one of its walls a circular recess with two cutting protuberances in spaced longitudinal positions, said protuberances being usable as a crown cork lifter, and presenting at said extremity which is closer to the spiral a pair of arms which are hinged to a same pin and having substantially different lengths; the two arms are provided at their respective extremities with stepped portions so that they can bear against the upper edge of the neck of the bottle; the longer arm has a wide opening traversed by the shorter arm.

6 Claims, 3 Drawing Sheets

PORTABLE CORK-SCREW

OBJECT OF THE INVENTION

The present invention refers to an improved portable cork-screw, contributing basically novel features and important advantages with respect to similar devices known and used for the same purpose in the present state of the art.

More specifically, the invention proposes the development of a device that may be used as a cork-screw, with a sufficiently reduced size to be able to be carried by the user, making it possible to perform, comfortably and simply, the removal of a bottle cork with a minimum effort and applicable to any type of stopper, independently from its characteristics or size by a single operation, or in two stages depending on the length of the cork in question. Moreover, the design of the cork-screw has been conceived in such a way that it also provides, in the same body, means to cut the capsules that may cover the cork itself.

The field of application of the invention is in the industry dedicated to the manufacture of household items, gifts, promotion and similar items, as well as for industrial and domestic use.

BACKGROUND AND SUMMARY OF THE INVENTION

Several devices that may be used as cork-screws are known in the state of the art, with structural designs and Several devices that may be used as cork-screws are known in the state of the art, with structural designs and widely varied shapes. Generally, all these devices are provided with a suitable spiral component to be "screwed" in the bottle cork to be removed and at least, a handle component by which the user applies the pulling effort during the cork removal operation.

In the case of portable cork-screws, that is, those that may be easily carried by the user in a pocket, it is logical that the size is reduced to a maximum, trying to maintain, as far as possible, the advantages of comfort and easy use as others of a greater size. On many occasions this situation leads to the adoption of complicated solutions giving structurally complex devices with a difficult design.

Therefore, a practical necessity exists of making a portable cork-screw which with a simple design may be quickly, comfortably and simply applied to all types of corks independently from their features and sizes.

The solution to the above problem has been solved by the cork-screw of the present invention, by which it is possible to uncork in a really effective way, in any type of situation, and with corks whose sizes may be very short, short, medium, long and very long, for which the cork-screw has been provided with two support arms on the upper edge of the bottle rim, both arms having different sizes, namely, a reduced one and the other with normal length, the first of these arms being incorporated in the second arm and both fastened to the cork-screw body by means of a single, union point and both crossed by a same pin which pivots them to the body, such that when the cork is penetrated with the cork screw spiral, totally independent support points may be available within the same assembly, without being separated parts and without having also separated supports or fastenings, both arms being found in the same space and permitting that the spiral penetrates in the cork until a desired position, adjusting this penetration to the length of the cork and without completely passing through it if not desired.

As a result of the arrangement of the short arm, housed or incorporated in the longer one, the size of the cork-screw is effectively reduced by several centimetres with respect to similar ones in the current state of the art, such that an object results which may be easily carried in the user's pocket.

As will be understood, depending on the length of the cork, either the shorter or longer arm may be used. Activation of the cork-screw body in its approach movement to the bottle to lean on the selected arm, makes the other arm, as relevant, to automatically separate from the bottle, leaving the space free for the easy handling of the assembly. This characteristic will be explain with greater detail below.

On the other hand, the invention foresees that the cork-screw body incorporates, as has been said, decapsulating means, which preferably consist of small curved, chamfered portions integrated with the body, made in an arched recess, provided in a part of said body. The arrangement of this portions, together with the own shape and sizing of the mentioned recess, make the decapsulating operation, clean, comfortable, fast and effective.

BRIEF DESCRIPTION OF THE DRAWINGS

These and other features and advantages of the invention may be more clearly understood by the following detailed description of a preferred embodiment thereof, given only as an illustrative and non-limiting example, referring to the attached drawing, in which.

DESCRIPTION OF THE PREFERRED EMBODIMENT

Figure 1:
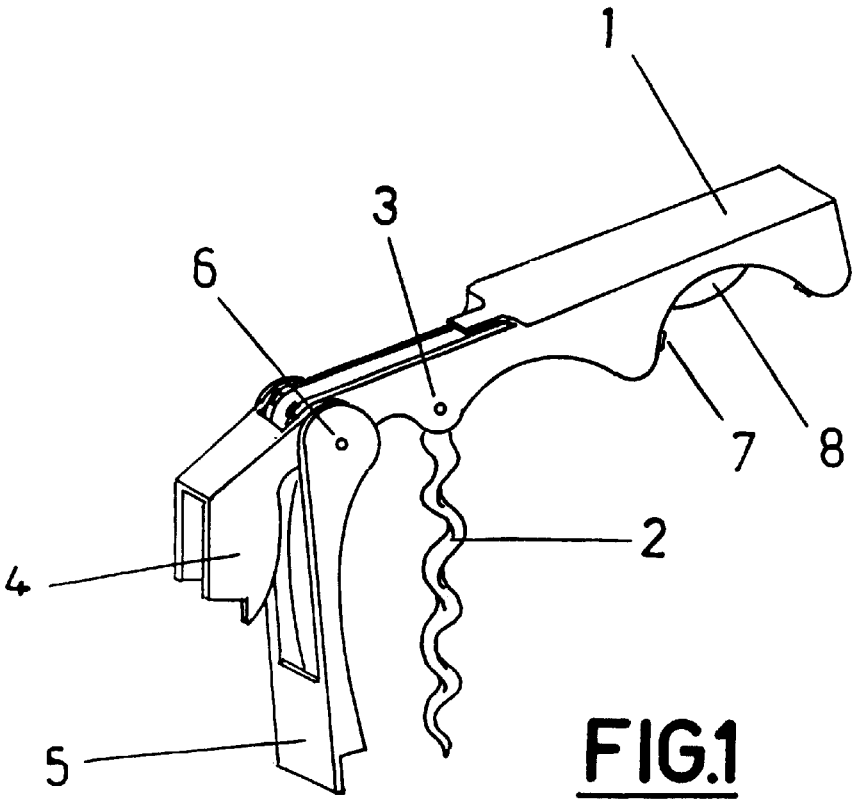
FIG. 1 shows a perspective view of a cork-screw constructed according to the present invention.

According to that expressed above, the detailed description of the preferred embodiment of the invention will be carried out with the use of the figures of the attached drawings by which, the same numerical references have been used to mark equal or similar parts. Therefore, firstly referring to FIG. 1 of the drawings, the representation may be seen in perspective of a cork-screw constructed according to the invention in which a body (1) is seen, consisting of a rigid, longitudinal component, preferably metallic, as a "C" shaped profile, to whose opposite side walls, a conventional spiral shaped extraction means (2) has been articulated, by means of a pin (3) near to one of the ends, destined to be nailed in the cork by means of a rotational movement identical to that made with any other known cork-screw. In this same mentioned end, two arms (4,5) are articulated by means of a same pin (6) and therefore, in a single position, of which, one arm (4) has considerably less length than the other arm (5), both mentioned arms having stepped ends for their easier coupling to the upper edge of the bottle rim carrying the cork to be removed, and of which one of the arms, particularly the shorter one (4), has a slightly less width and is incorporated or housed in the inner space of the other arm (5), the latter having a wide opening through which the shorter one may pass. Moreover, the body 1) has been provided with means to easily decapsulate the bottle, said means consisting of two small slightly protruding portions (7), made over the profile of an arched recess made in one of the side walls of the body. The portion (8), correspondingly in front of the opposite wall, is kept intact, such that in the decapsulating operation, it serves as a stop for the upper edge of the bottle, such that it is the own body width (1) which defines the distance to which the cut should be made over the bottle capsule.

The design given to the cork-screw assembly being described, allows a considerable reduction of size (several centimetres with respect to a similar corkscrew), due to the articulation of both arms at the same point and the possibility of housing in the closed position of the cork-screw of the shorter one (4) inside the longer one (5), besides permitting than the body (1) may have an ergonomic shape allowing a perfect grip by the user for easier handling.

Figure 2:
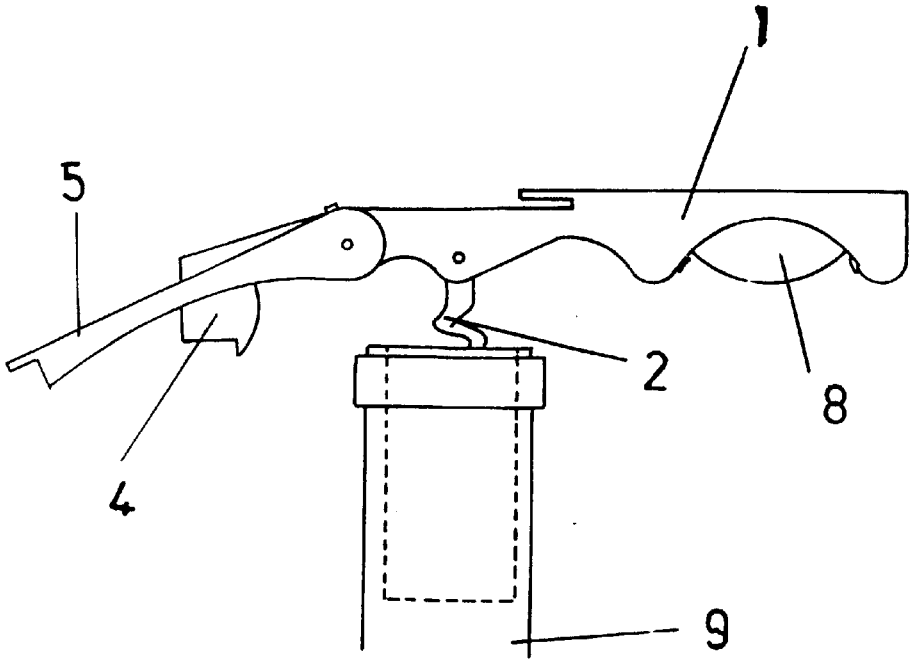
FIG. 2 shows a side elevated view of the cork-screw applied to a bottle, with the spiral introduced in the cork carried by the latter, and FIGS. 3 to 6 correspond to successive views in the side elevation of sequential operations related to the removal of a long cork of a predetermined size, with the use of the cork-screw of the present invention.

Referring to FIG. 2, the representation of an elevated view of the cork-screw of the invention is seen, applied to a bottle whose neck (9) has the cork (10) to be removed. In this Figure, the spiral (2) introduced in the cork (10) is seen. Moreover, said cork has been represented with a dotted line and a considerable length has been selected to be able to more easily understand the different operations involved in a complete removal sequence, the latter being represented in FIGS. 3 to 6.

Figure 3:
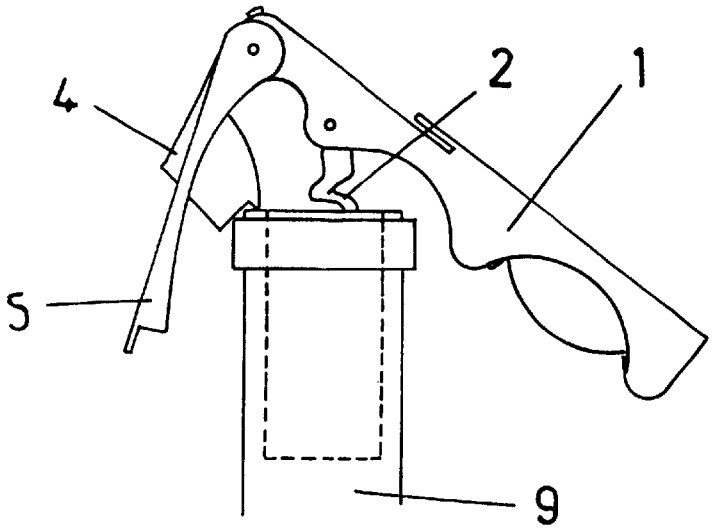
Figure 4:
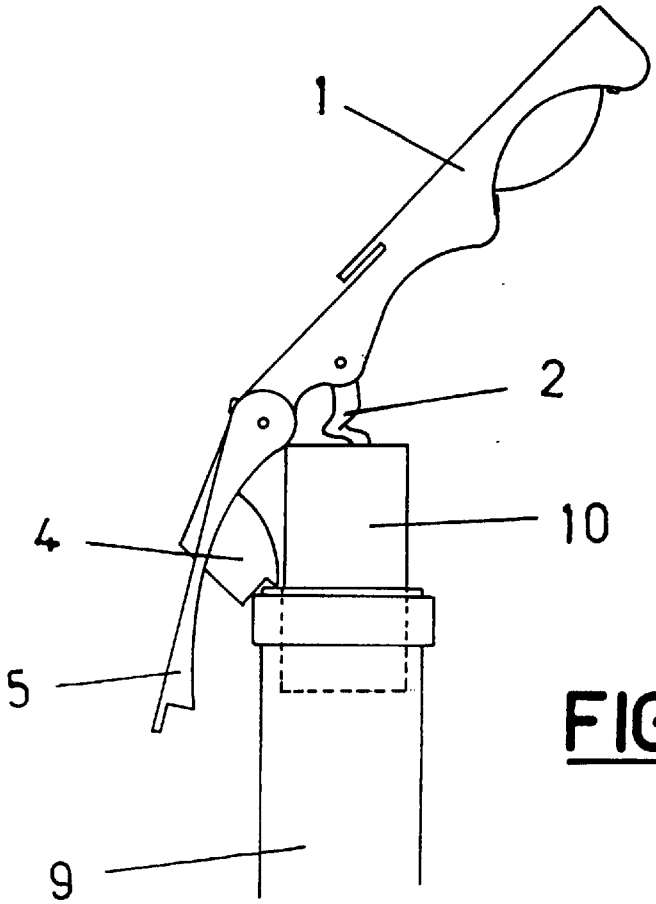

In fact, once the spiral is introduced as shown in FIG. 2, the following stage to remove a cork (10) consists in supporting the shorter arm (4), taking advantage of the stepping of its free end, over the bottle neck (9) rim, when the position of the cork-screw will be that shown in FIG. 3. By suitably holding the bottle with one hand, and applying an upwards pulling effort with the other hand, taking advantage of the lever effect provided by such a support, the cork is removed until a position similar to that shown in FIG. 4. It will be understood that if said cork (10) is short or very short, this movement will be sufficient to completely remove it, the removal operation finishing here, with the sole use of the shorter arm (4).

Figure 5:
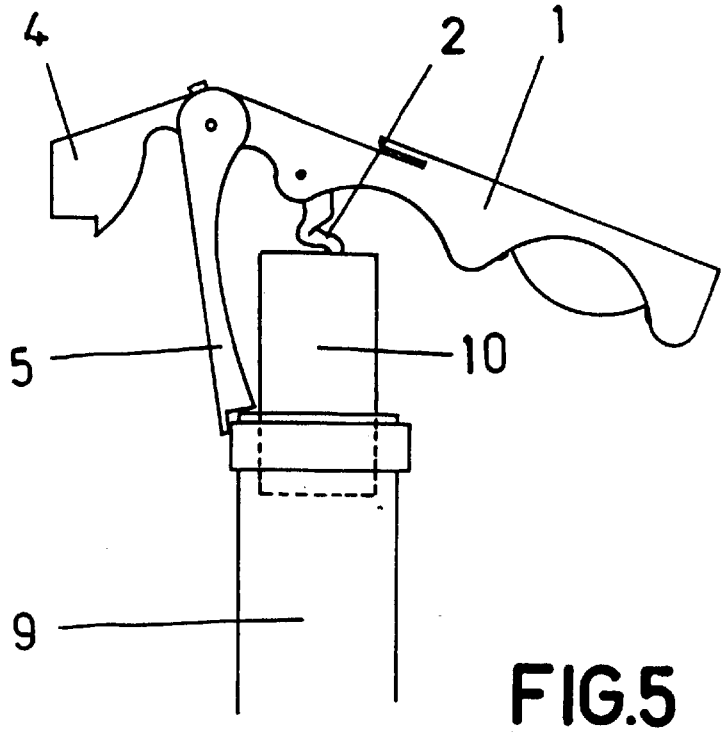
Figure 6:
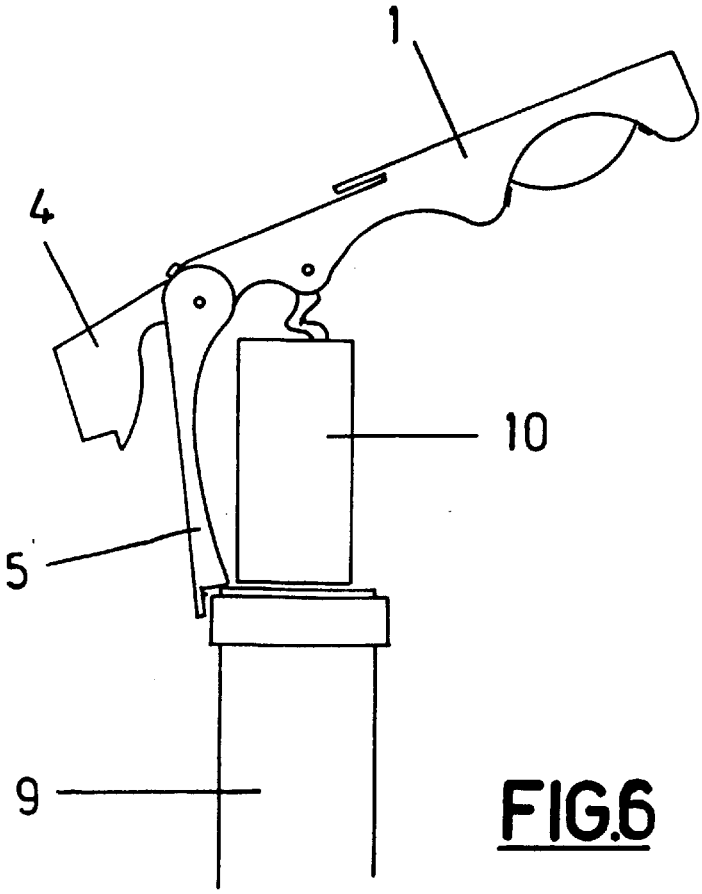

However, when a longer cork (10) is used and this first operation is not sufficient to remove it, the second support, of a greater height is used, provided by the longer arm (5). For this reason, once the first removal operation has finished, and with the assembly in the position shown in said FIG. 4, it will be enough to make the body (1) descend, such that the shorter arm, dragged by the body itself, is automatically separated from the bottle neck and in its place, the longer arm (5) may be applied, taking advantage of the stepping of its free end, as shown in FIG. 5 of the drawings. In this situation, it is sufficient to apply an adequate upwards pull over the body (1) to pass to the position of FIG. 6 and therefore, total removal of the cork.

From the above, it is clearly seen that the cork-screw design of the invention permits a comfortable and simple use thereof, independently from the type of cork in question. Moreover, the provision of a single articulation pin (6) for both arms (4, 5) with the body (1) permits the arrangement of relative dragging means, such that when any coupling or body (1) moving operation is performed, the arm not being used simultaneously moves with the body, being separated from the application space, and hence not representing any hindrance to handle the assembly. Finally, it will also be understood that the incorporated arm arrangement permits that, in the closed cork-screw position, both arms remain adapted to the body (1), with the spiral (2) inside the latter, hence occupying a minimum space making it especially recommended to be transported by the user in a pocket or any other place.

It is not considered necessary to extend this description for a skilled person to understand its scope and the advantages derived from the invention, as well as to develop and implement the purpose thereof.

Nevertheless, it should be understood that the invention has been described according to a preferred embodiment thereof, such that it may be modified without this representing any change of the basis of said invention, said modifications especially including the shape, the size and/or manufacturing materials.

What is claimed is:

1. A portable cork-screw for removing of corks, comprising a body; a spiral component articulately connected with said body and nailable by a manual rotation of movement into a cork to be removed; first means for articulatingly connected said spiral component to said body; two arms articulately connected to said body near said means for articulatingly connecting said spiral component with said body; second means for articulately connecting said two arms with said body, said two arms having free ends with stepped edges for supporting over an upper edge of a bottle rim carrying the cork to be removed, said arms including a longer arm having an opening and a shorter arm located inside and movable through said opening, said body being C-shaped and having two walls with one of said walls provided with a recess with two protuberances which form means for decapsulating the bottle.

2. A portable cork-screw as defined in claim 1, wherein said first means for articulatingly connecting said spiral component with said body consists of a single pin.

3. A portable cork-screw as defined in claim 1, wherein said recess in said C-shaped body is substantially arched.

4. A portable cord-screw as defined in claim 1, wherein said protuberances have a curved chaufered edge.

5. A portable cord-screw as defined in claim 1, wherein said shorter arm is formed so that when it is supported on an edge of a bottle rim it provides a sufficient operative distance for removal of substantially shorter corks, while said longer arm is formed so as to provide a sufficient operative distance for removal of larger corks.

6. A portable cord-screw as defined in claim 1, wherein said body has dragging means operative for automatically separating one of said arms which is not being used during a cork removal operation.

* * * * *